US007277667B2

(12) United States Patent
Saito et al.

(10) Patent No.: US 7,277,667 B2
(45) Date of Patent: Oct. 2, 2007

(54) ENDLESS BELT DEVICE AND IMAGE FORMING APPARATUS USING THE DEVICE

(75) Inventors: Daisuke Saito, Tokyo (JP); Ryuta Takeichi, Toyonaka (JP); Masaharu Furuya, Yokohama (JP); Takahiro Nakayama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/266,331

(22) Filed: Nov. 4, 2005

(65) Prior Publication Data

US 2006/0104677 A1 May 18, 2006

(51) Int. Cl.
*G03G 15/01* (2006.01)

(52) U.S. Cl. ..... 399/301

(58) Field of Classification Search ..... 399/301, 399/167

See application file for complete search history.

(56) References Cited

U.S. PATENT DOCUMENTS 5,923,032 A * 7/1999 Carlson et al. ..... 250/231.13
6,759,648 B2 * 7/2004 Baxter et al. ..... 250/231.13
2003/0002887 A1 * 1/2003 Imaizumi et al. ..... 399/167

FOREIGN PATENT DOCUMENTS

| | | |
|---|---|---|
| JP | 10274888 A * | 10/1998 |
| JP | 3186090 | 5/2001 |
| JP | 2001-306149 | 11/2001 |
| JP | 2002-251079 | 9/2002 |

OTHER PUBLICATIONS

U.S. Appl. No. 11/521,472, filed Sep. 15, 2006, Shinshi, et al.

* cited by examiner

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

An endless belt device includes an endless belt and a plurality of rotary members rotatably supporting the endless belt. One of the plurality of rotary members includes a marker formed on a part of a circumferential surface of a rotation axis thereof. A reflection-type sensor is arranged to oppose the circumferential surface of the rotation axis of the one of the plurality of rotary members to detect the marker formed on the circumferential surface. A rotation speed of the endless belt is detected by detecting the marker on the circumferential surface of the rotation axis of the one of the plurality of rotary members by the reflection-type sensor.

13 Claims, 7 Drawing Sheets

ENDLESS BELT DEVICE AND IMAGE FORMING APPARATUS USING THE DEVICE

BACKGROUND OF THE INVENTION

1. Field of the Invention

The present invention relates to an endless belt device provided with an endless belt for bearing an image or a medium for forming an image or for pressing the medium, and an image forming apparatus using the endless belt device, such as a copier, a printer, a facsimile apparatus, etc.

2. Discussion of the Background

A tandem-type color image forming apparatus in which a plurality of photoconductors as image bearing members are arranged side-by-side obtains a full color image on a recording medium by transferring toner images formed on respective photoconductors onto an endless belt as an intermediary transfer member, sequentially, to be superimposed on top of each other and by transferring the superimposed toner images onto the recording medium in a lump.

In the image forming apparatus, the toner images formed on the plurality of photoconductors are transferred onto the intermediary transfer member, sequentially, starting with the one at the most upstream side in the direction in which the intermediary transfer member is conveyed, and the timings of transferring the toner images from respective photoconductors are sequentially delayed so that the transferred toner images are superimposed on top of each other. The speed of the intermediary transfer belt is detected with a detection device, and when a variation is caused in the speed, the timings of transferring respective toner images are appropriately adjusted.

Similarly, in an image forming apparatus in which toner images formed on a plurality of photoconductors are transferred onto a recording medium being born on and conveyed by an endless belt, sequentially, while being superimposed on top of each other, the speed of the endless belt is detected and the timings of transferring the toner images are adjusted.

Various methods of detecting the speed of an endless belt have been proposed. For example, Japanese Patent Laid-open publication 2002-251079 describes a method of providing a speed detection device (a light transmittance-type sensor) configured to generate a signal by transmitting and shielding a light, at a part of an end part of an axis of a driven roller driven by an endless belt, which is cut in a shape of "D", and controlling the speed of the endless belt based on the information from the speed detection device.

Also, Japanese Patent Laid-open publication No. 4-234064 (Japanese Patent publication No. 3186090) describes a speed detection device using an encoder disk.

Further, Japanese Patent Laid-open publication No. 2001-306149 describes a method of detecting the speed of a rotary member such as a photoconductor drum by detecting a marker provided on the rotary member in the circumferential direction thereof, using a marker sensor constituted of a photo-interrupter.

In the speed detection method using an encoder disk, however, a detection mechanism protrudes from an end part of a rotation axis, and a disk with an axis having a diameter larger than that of the rotation axis is necessary for the detection mechanism, so that the detection mechanism is relatively large.

In the method of using a transmittance-type sensor at a D-shaped part of an end part of an axis, the detection mechanism is relatively large, similarly, and further, it is difficult to arbitrarily set the number of markers, so that adjustment of the detection accuracy is difficult.

In the method of providing a marker on a photoconductor drum in the circumferential direction thereof and detecting the marker by a photo-interrupter, the photo-interrupter cannot be close to the photoconductor drum due to a concern that the photoconductive property of the photoconductor drum is affected, so that the detection accuracy cannot be increased so much. Further, there is a concern that the charged marker electrostatically affects the surface of an endless belt arranged close to the photoconductor drum.

Further, generally, the detection region of a detection device is in an environment that toner and dust float, so that the concern exists that in the long term, the toner and the dust adhere to the detection device and the detection accuracy decreases.

SUMMARY OF THE INVENTION

The present invention has been made in views of the above-discussed and other problems and addresses the above-discussed and other problems.

Preferred embodiments of the present invention provide a novel endless belt device with an endless belt that can accomplish reducing the size of a detection device detecting the speed of the endless belt and enhancing the detection accuracy of the detection device and that can decrease an electrostatic effect by the detection device relative to the surface of the endless belt, and a novel image forming apparatus using the endless belt device.

The preferred embodiments of the present invention further provide a novel endless belt device with an endless belt that can maintain satisfactory detection accuracy of a detection device detecting the speed of the endless belt, for a long term, and a novel image forming apparatus using the endless belt device.

According to an embodiment of the present invention, an endless belt device includes an endless belt and a plurality of rotary members rotatably supporting the endless belt. One of the plurality of rotary members includes a marker formed on a part of a circumferential surface of a rotation axis thereof, and a reflection-type sensor is arranged to oppose the circumferential surface of the rotation axis of the one of the plurality of rotary members to detect the marker formed on the circumferential surface. A rotation speed of the endless belt is detected by detecting the marker on the circumferential surface of the rotation axis of the one of the plurality of rotary members by the reflection-type sensor.

Thus, in the endless belt device, a separate member (e.g., an encoder) for forming a marker is not required within the rotation surface of the endless belt, and the reflection-type sensor as a detection member is arranged only at one side of the circumferential surface of the rotation axis, so that reducing the size of the detection mechanism is realized. Further, because the marker is not formed on the endless belt, the electrostatic effect to the surface of the endless belt is decreased.

The endless belt device may further include a sensor holder supporting the reflection-type sensor. The sensor holder may include a bearing part accommodating the rotation axis of the one of the plurality of rotary members, and the reflection-type sensor and the circumferential surface of the rotation axis of the one of the plurality rotary members may be positioned with the sensor holder. Further, the bearing part of the sensor holder and the rotation axis of the one of the plurality of rotary members may slide in contact with each other.

Thereby, the reflection-type sensor and the marker are positioned with high accuracy, so that enhancing the detection accuracy is realized.

Furthermore, the reflection-type sensor and the part of the circumferential surface of the rotation axis of the one of the plurality of rotary members on which the marker is formed may be enclosed in an airtight state. Still further, the sensor holder may be configured such that at least a periphery of a detection region of the reflection-type sensor does not have a light transmittance function.

Thereby, an erroneous operation of the reflection-type sensor, which may be caused by toner and/or dust adhering to the reflection-type sensor and/or the marker or a light invaded from outside, is avoided.

Still furthermore, in the above-described endless belt device, the marker may be formed by differentiating surface roughness of the part of the circumferential surface of the rotation axis of the one of a plurality of rotary members where the marker is formed from that of the other part of the circumferential surface. In this case, the circumferential surface of the rotation axis of the one of a plurality of rotary members may be made of a metal, and the marker may be formed by differentiating surface roughness of the part of the circumferential surface of the rotation axis where the marker is formed from that of the other part of the circumferential surface by surface treatment.

In the above-described endless belt device, the endless belt may bear an image or a recording medium for forming an image thereupon, or may contact and press a recording medium on which an image has been formed.

According to another embodiment of the present invention, an image forming apparatus including a photoconductor and the above-described endless belt device, in which an image formed on the photoconductor is transferred onto the endless belt of the endless belt device, is provided.

According to still another embodiment of the present invention, an image forming apparatus including a photoconductor and the above-described endless belt device, in which an image formed on the photoconductor is transferred onto a recording medium born on the endless belt of the endless belt device, is provided According to still another embodiment of the present invention, an image forming apparatus including a photoconductor and the above-described endless belt device, in which the endless belt of the endless belt device is brought into contact with a recording medium on which an image formed on the photoconductor has been transferred, is provided.

BRIEF DESCRIPTION OF THE DRAWINGS

A more complete appreciation of the present invention and many of the attended advantages thereof will be readily obtained as the present invention becomes better understood by reference to the following detailed description when considered in connection with the accompanying drawings, wherein.

DETAILED DESCRIPTION OF THE PREFERRED EMBODIMENTS

Figure 1:
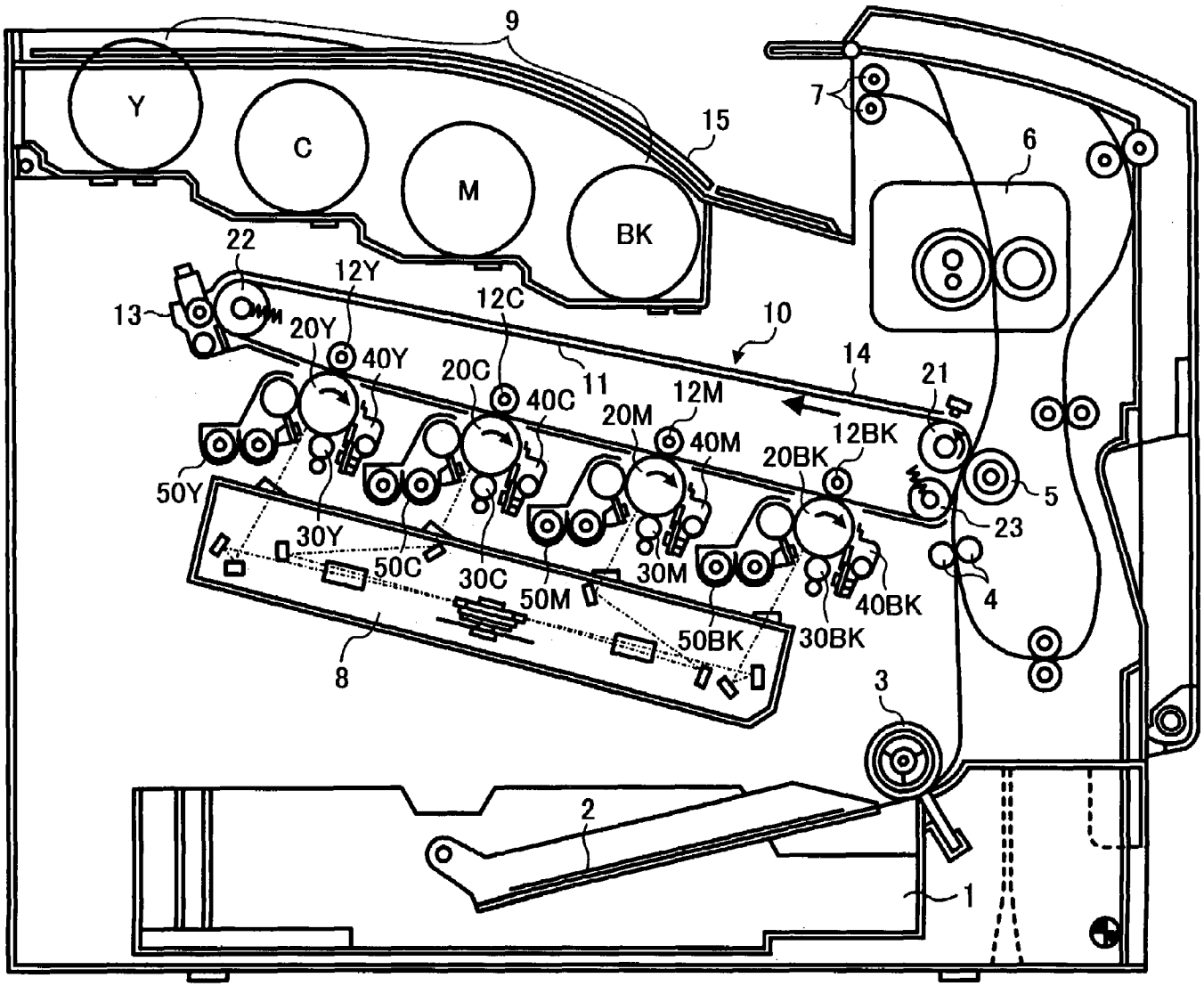
FIG. 1 is a diagram schematically illustrating the construction of a color printer as an image forming apparatus according to an embodiment of the present invention.

Referring now to the drawings, wherein like reference numerals designate identical or corresponding parts throughout the several views, preferred embodiments of the present invention are described.

FIG. 1 is a diagram schematically illustrating the construction of a color printer as an image forming apparatus according to an embodiment of the present invention. A transfer belt unit 10 as an endless belt device of the present invention, having an intermediary transfer belt 11 as an endless belt, and four image formation stations are arranged at the center part of the apparatus main body.

The image formation stations include photoconductor drums 20Y, 20C, 20M, and 20BK, respectively, and charging devices 30Y, 30C, 30M, and 30BK, development devices 50Y, 50C, 50M, and 50BK, and cleaning devices 40Y, 40C, 40M, and 40BK are arranged around the photoconductor drums 20Y, 20C, 20M and 20BK, respectively.

A toner bottle group 9 for replenishing toner is arranged at an upper part of the apparatus main body. Yellow (Y) toner, cyan (C) toner, magenta (M) toner, and black (BK) toner are contained in respective toner bottles from the left side to the right side in figure, and predetermined quantities of respective toners are replenished to the development devices 50Y, 50C, 50M, and 50BK, respectively, through a conveying path (not shown).

A transfer sheet 2 as a recording medium is fed from a sheet feed cassette 1 by a feed roller 3. When a tip end of the transfer sheet 2 has reached a registration roller pair 4, a sensor (not shown) detects the tip end of the transfer sheet 2, and the transfer sheet 2 is timed, based on the detect signal, to be conveyed to a nip part of a secondary transfer roller 5 and the intermediary transfer belt 11 by the registration roller pair 4.

The photoconductor drums 20Y, 20C, 20M, and 20BK uniformly charged in advance by the charging devices 30Y, 30C, 30M, and 30BK are exposed and scanned by a laser light emitted by an optical writing device 8, and thereby electrostatic latent images are formed on the photoconductor drums 20Y, 20C, 20M, and 20BK, respectively.

The electrostatic latent images are developed with the development devices 50Y, 50C, 50M, and 50BK, respectively, so that toner images of yellow, cyan, magenta, and black are formed on the photoconductor drums 20Y, 20C, 20M, and 20BK.

Then, primary transfer voltages are applied to primary transfer rollers 12Y, 12C, 12M, and 12BK, and the toner images on the photoconductor drums 20Y, 20C, 20M, and 20BK are sequentially transferred onto the intermediary transfer belt 11. At this time, the timings of transferring respective toner images are delayed sequentially from the upstream side to the downstream side in the conveying direction of the intermediary transfer belt 11 so that the toner images are correctly superimposed on top of each other on the intermediary transfer belt 11.

The superimposed toner images on the intermediary transfer belt 11 are conveyed to the position of a secondary transfer roller 5 and are transferred in a lump to the transfer sheet 2, and thereby a full color image is obtained on the transfer sheet 2. The transfer sheet 2 is conveyed to a fixing device 6, and the full color image on the transfer sheet 2 is fixed to the transfer sheet 2 by heat and pressure. The transfer sheet 2 is then discharged with a discharge roller pair 7 to a discharge tray 15 forming an upper surface of the apparatus main body.

Residual toner on the photoconductor drums 20Y, 20C, 20M, and 20BK are removed by the cleaning devices 40Y, 40C, 40M, and 40BK, and thereafter, the surfaces of the photoconductor drums 20Y, 20C, 20M, and 20BK are discharged, and at the same, are charged to be ready for subsequent image formation by the charging devices 30Y, 30C, 30M, and 30BK to which voltages in which DC and AC bias have been superimposed are applied.

Residual toner on the intermediary transfer belt 11 is removed by an intermediary transfer belt cleaning device 13 to be ready for subsequent image formation.

The intermediary transfer belt 11 is spanned around and is supported by a drive roller 21 as a rotary member, a driven roller 22 as a rotary member opposing the intermediary transfer belt cleaning device 13, and an entry roller 23 as a rotary member forming an entry form of the intermediary transfer belt 11 to guide the transfer sheet 2 conveyed from the registration roller pair 4 to the nip part of the secondary transfer roller 5 and the intermediary transfer belt 11.

Figure 2:
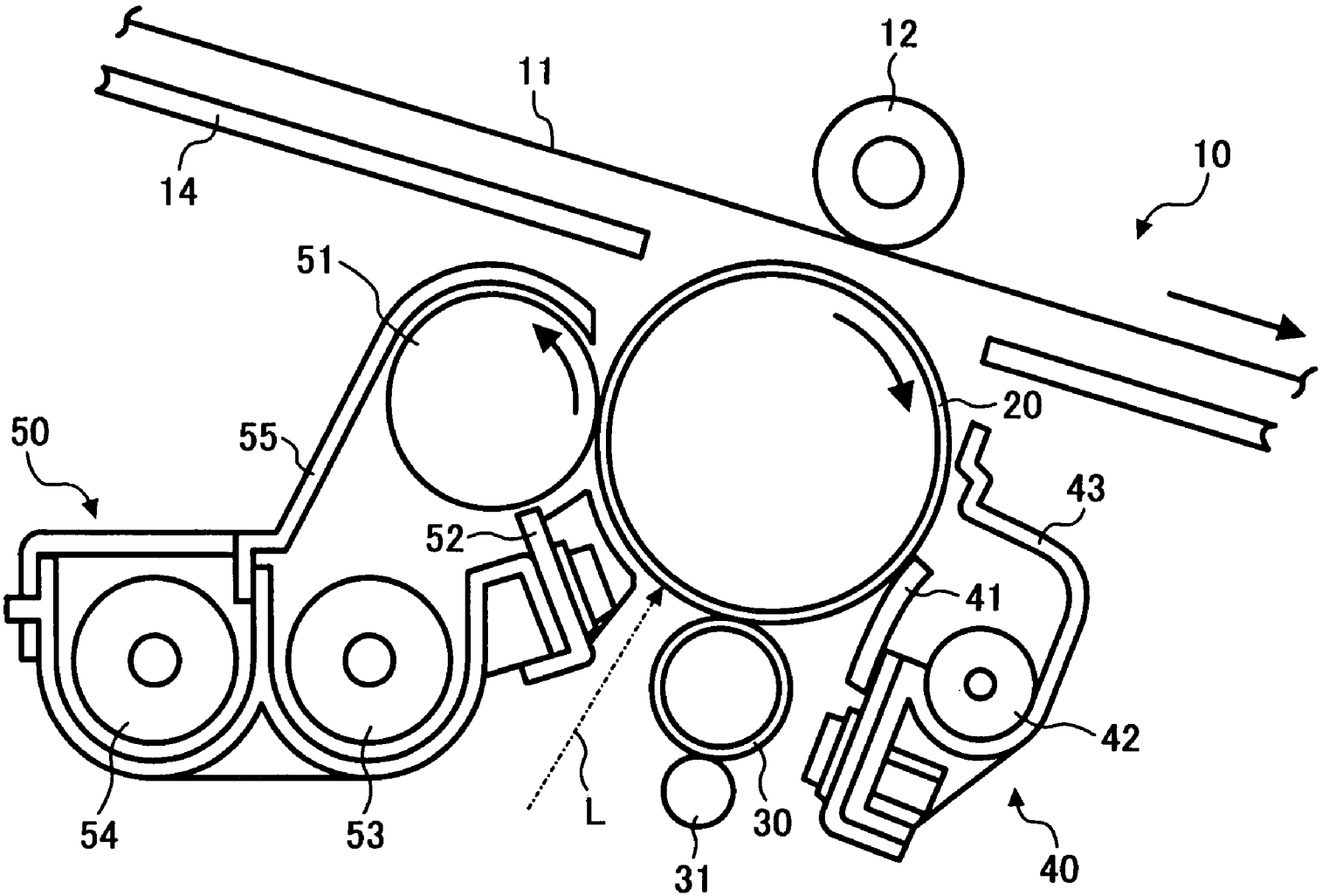
FIG. 2 is a diagram schematically illustrating the construction of each image formation station of the color printer.

FIG. 2 is a diagram schematically illustrating the construction of each image formation station. Here, symbols for indicating colors are not appended to respective reference symbols. A charging device 30 is constituted of a charging roller arranged to contact or in the vicinity of a photoconductor drum 20, and a cleaning roller 31 is arranged to contact the charging device 30.

A development device 50 includes stirring/conveying members 53 and 54 stirring and conveying developer accommodated in a development casing 55 to be circulated in the developer casing 55. The developer is supplied to a development roller 51 from the stirring/conveying member 53, and toner of the developer is supplied to the photoconductor drum 20 from the development roller 51. Reference symbol 52 denotes a doctor blade regulating the thickness of a layer of the developer on the development roller 51.

A cleaning device 40 includes a cleaning casing 43, a cleaning blade 41, and a collecting member 42 conveying and collecting the toner scraped off the photoconductor drum 20 by the cleaning blade 41. Reference symbol L denotes a laser light from the optical writing device 8, and reference symbol 14 denotes a frame of the transfer belt unit 10. The transfer belt unit 10 is driven by a drive mechanism (not shown) such that the intermediary transfer belt 11 contacts the photoconductor drum 20 when transferring an image and such that the intermediary transfer belt. 11 separates from the photoconductor drum 20 after transferring the image.

Figure 3:
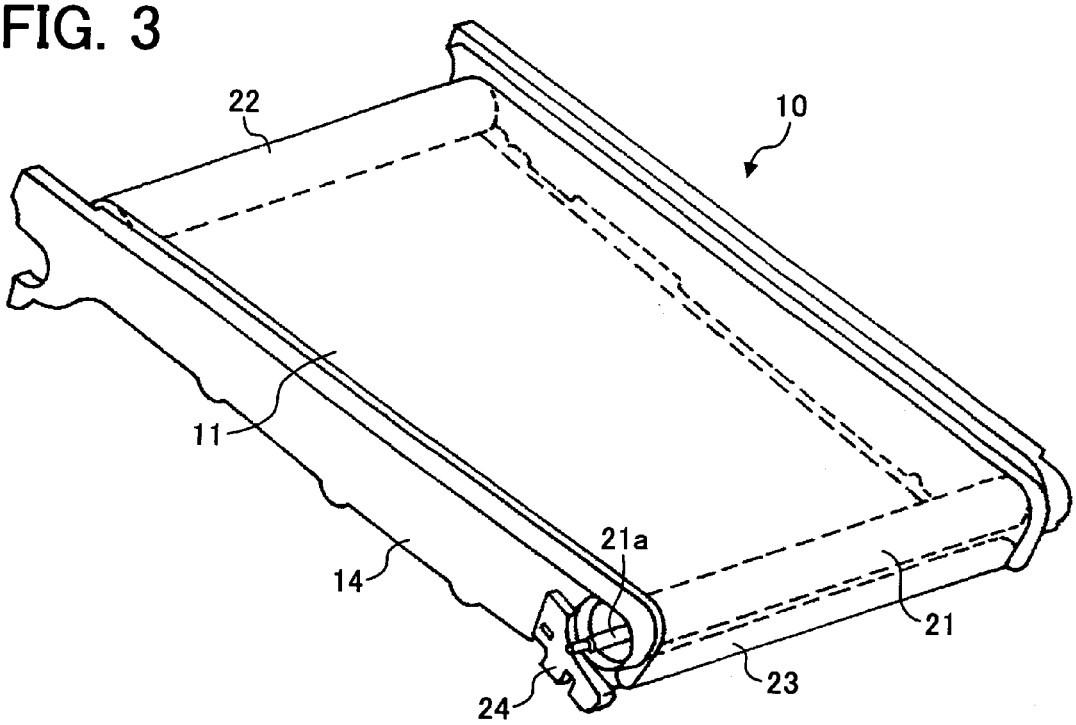
FIG. 3 is a perspective view of a transfer belt device of the color printer as an endless belt device according to an embodiment of the present invention.

FIG. 3 is a perspective view of the transfer belt unit 10. The transfer belt unit 10 integrally includes a frame 14 having a base surface and both side surfaces, the drive roller 21 rotatably supported by the both side surfaces of the fame 14 and driven by a drive source (not shown), the driven roller 22 rotatably supported by the both side surfaces of the frame 14, an entry roller 23, a primary transfer roller 12 (not shown in FIG. 3), the intermediary transfer belt 11, and the intermediary transfer belt cleaning device 13 (not shown in FIG. 3).

A sensor holder 24 including a reflection-type sensor for detecting a marker (described later) is provided to a part of the outer side of one side surface of the frame 14, at the side of the entry roller 23. Reference symbol 21*a* denotes a rotation axis of the drive roller 21.

Figure 4:
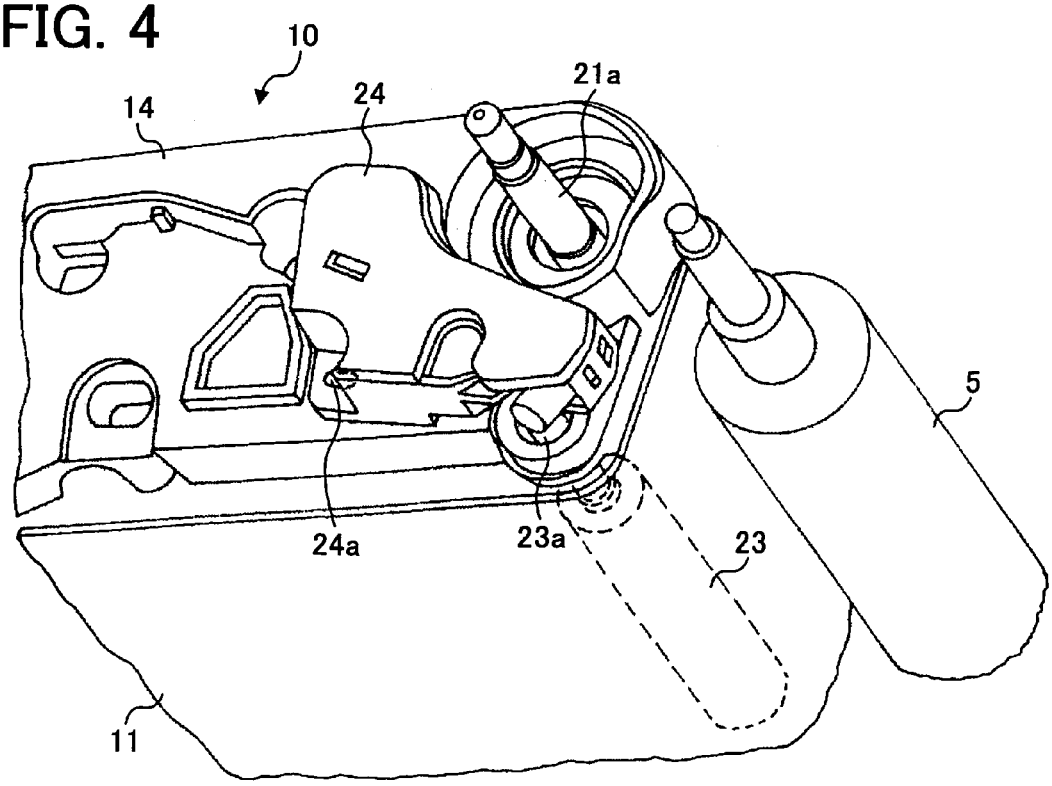
FIG. 4 is a perspective view illustrating a state that a sensor holder is mounted to a frame of the transfer belt device.

FIG. 4 is a perspective view illustrating a state that the sensor holder 24 is mounted to the frame 14. An end part of a rotation axis 23*a* of the entry roller 23 is accommodated in a bearing part (described later) of the sensor holder 24, and thereby a positioning reference for the sensor holder 24 is set, and the sensor holder 24 is positioned by being fixed to the frame 14 by a screw (not shown) via a long hole 24*a*.

Figure 5:
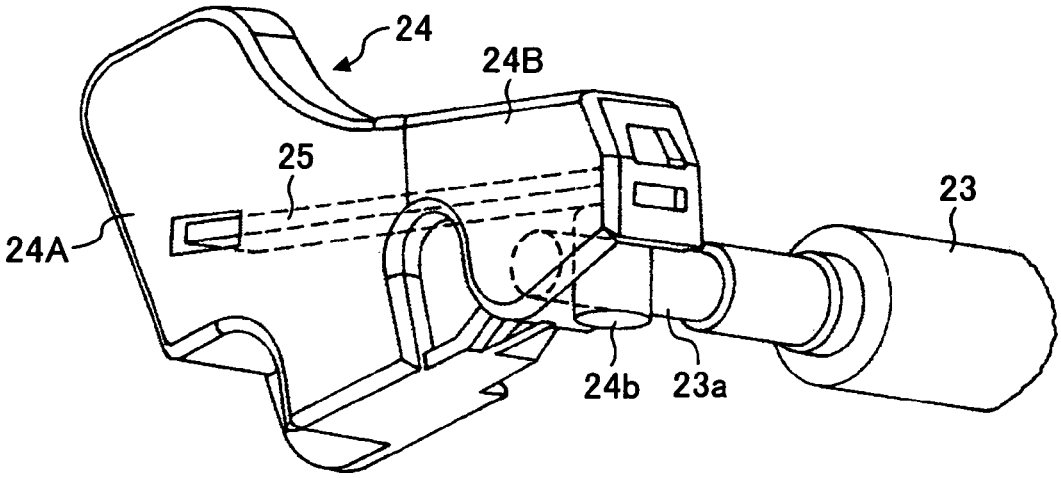
FIG. 5 is a perspective view illustrating connection between the sensor holder and a rotation axis of an entry roller of the transfer belt device.

FIG. 5 is a perspective view illustrating connection between the sensor holder 24 and the rotation axis 23*a* of the entry roller 23. As illustrated in FIG. 5, the sensor holder 24 includes a holder main body 24A and a sensor cover 24B. The sensor cover 24B is fixed by being engaged with a part of the holder main body 24A at the side of the bearing part from above.

A sensor base plate 25 of a shape of a band plate is accommodated within the holder main body 24A, and the sensor base plate 25 is fixed by a screw to a boss 24*b* of a cylinder shape integrally formed with the part of the holder main body 24A at the side of the bearing part.

Figure 6:
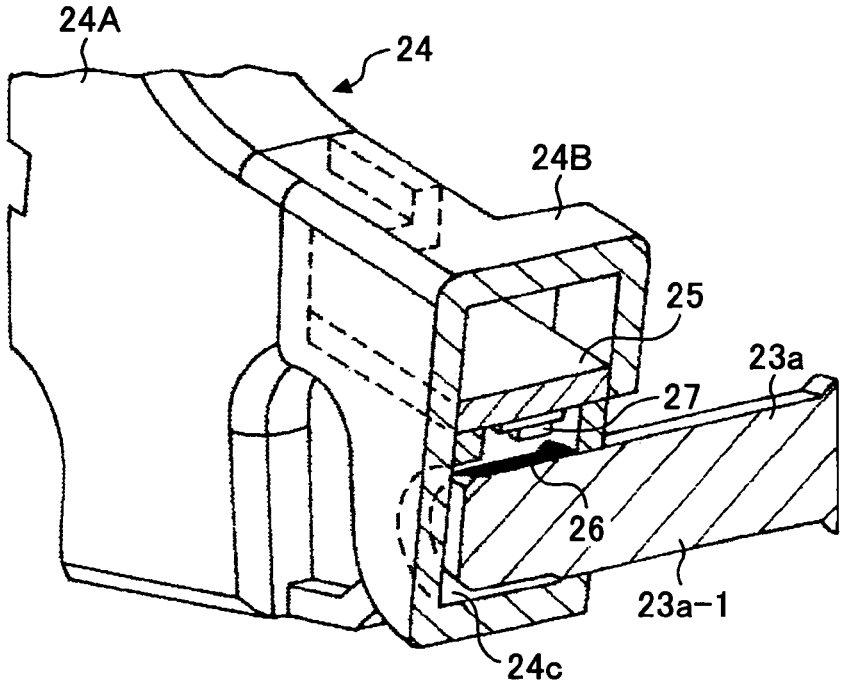
FIG. 6 is a perspective cross section illustrating a periphery of a bearing part of the sensor holder.
Figure 7:
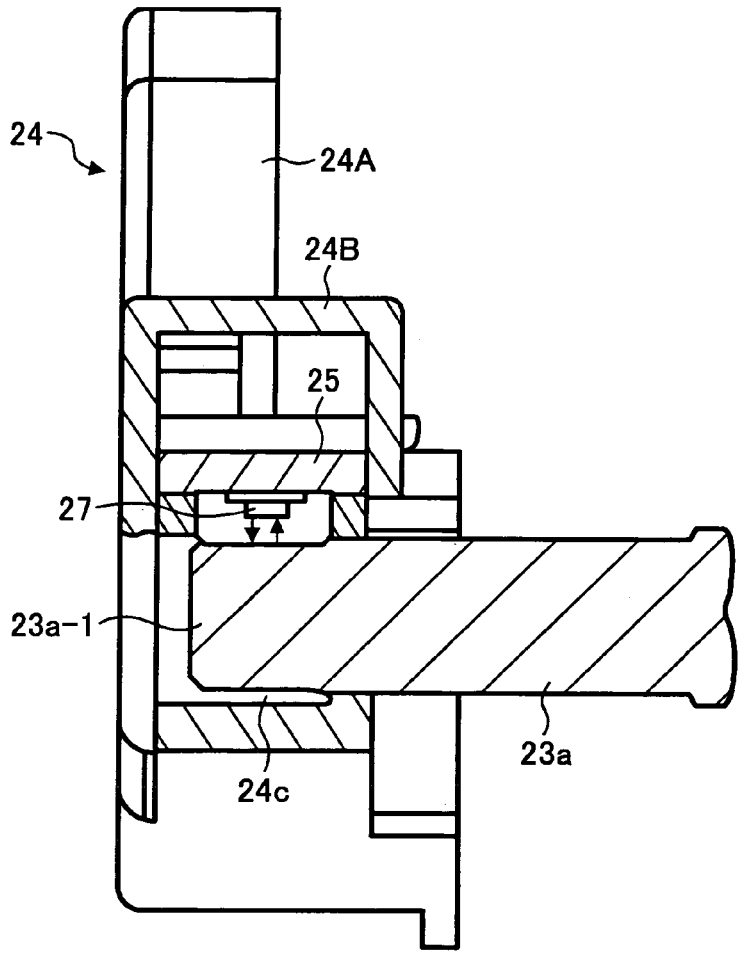
FIG. 7 is a cross section of the periphery of the bearing part of the sensor holder.

FIG. 6 is a perspective cross section illustrating a periphery of the bearing part of the sensor holder 24, and FIG. 7 is a cross section of the periphery of the bearing part of the sensor holder 24. As illustrated in FIG. 6 and FIG. 7, a bearing part 24*c* is formed in the holder main body 24A, and the end part of the rotation axis 23*a* of the entry roller 23 is slidably accommodated in the bearing part 24*c*. In this embodiment, for decreasing abrasion of the bearing part 24*c* due to sliding movement of the end part of the rotation axis 23*a*, the holder main body 24A is formed of a resin superior in the solid lubricating property and the mechanical strength (e.g., polyacetal, polycarbonate, etc.). Bearing may be used in the bearing part 24*c*.

A marker 26 in black is formed on the circumferential surface of a tip end part 23*a*-1 of the rotation axis 23*a*, and a reflection-type sensor 27 is fixed to the under surface of the sensor base plate 25 opposing the circumferential surface of the tip end part 23*a*-1 to detect the marker 26 on the circumferential surface.

By accommodating the end part of the rotation axis 23*a* in the bearing part 24*c* and by fixing the sensor holder 24 to the frame 14, the reflection-type sensor 27 and the marker 26 are positioned with high accuracy.

The end part of the rotation axis 23*a* of the entry roller 23 (except the tip end part 23*a*-1) is accommodated in the bearing part 24*c* in a sliding state, that is, in a close contact state, and the lower side thereof is surrounded with the bearing part 24*c* and the upper side thereof is surrounded with the sensor cover 24B. That is, the sensor holder 24 is formed in such a shape that the positional relation between the entry roller 23 and the sensor base plate 25 is maintained in a state that the surface of the rotation axis 23*a* of the entry roller 23 where the marker 26 is formed (printed) does not slide in contact with the sensor holder 24.

Thus, the circumferential surface of the tip end part 23*a*-1 of the rotation axis 23*a* where the marker 26 is formed and a detection region by the reflection-type sensor 27 are enclosed in an airtight state that toner and dust does not enter from outside. Thereby, the reflection-type sensor 27 and the region of the circumferential surface of the tip end part 23*a*-1 of the rotation axis 23*a* where the marker 26 is formed are prevented from being stained by toner and/or dust and at the same time, invasion of light from outside is prevented, so that an erroneous operation of the reflection-type sensor 27 due to adhering of toner and/or dust or invasion of light is avoided.

Further, in this embodiment, to securely prevent the erroneous operation of the reflection-type sensor 27 due to invasion of light from outside, the holder main body 24A and the sensor cover 24B are made in a color having no light transmittance function (e.g., black). Between the holder main body 24A and the sensor cover 24B, at least, the sensor cover 24B may be made of a material having lower reflectivity. Further, only the inside of the holder main body 24A and the sensor cover 24B may be made in black. Thereby, irregular reflection of light within the sensor holder 24 can be decreased, so that the detection accuracy by the reflection-type sensor 27 can be prevented from being decreased.

The sensor holder 24 may be made of a member having no light transmittance function or may be coated with a color having no light transmittance function. When coating the sensor holder 24, only the periphery of the detection region of the refection-type sensor 27 may be coated to the extent that an erroneous operation of the reflection-type sensor 27 due to invasion of light from outside is not caused.

Figure 8:
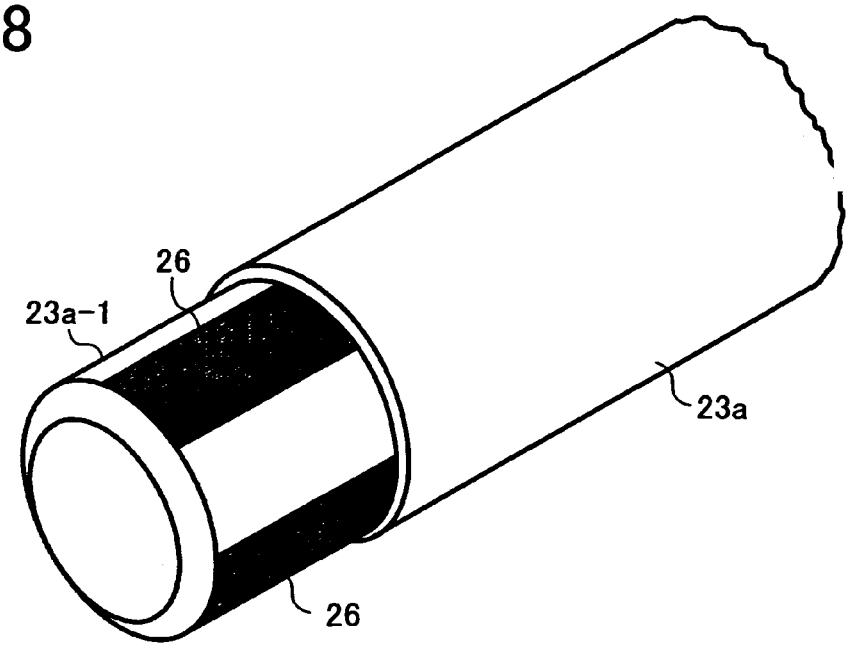
FIG. 8 is a perspective view illustrating a state that a marker has been formed on an end part of the rotation axis of the entry roller.

FIG. 8 is a perspective view illustrating a state that the marker 26 has been formed on the circumferential surface of the tip end part 23*a*-1 of the rotation axis 23*a* of the entry roller 23. A plurality of the markers 26 are formed on the circumferential surface of the tip end part 23*a*-1 of the rotation axis 23*a* at even intervals in the rotation direction of the entry roller 23. The marker 26 may be formed by Tampo (pad) printing.

Figure 9:
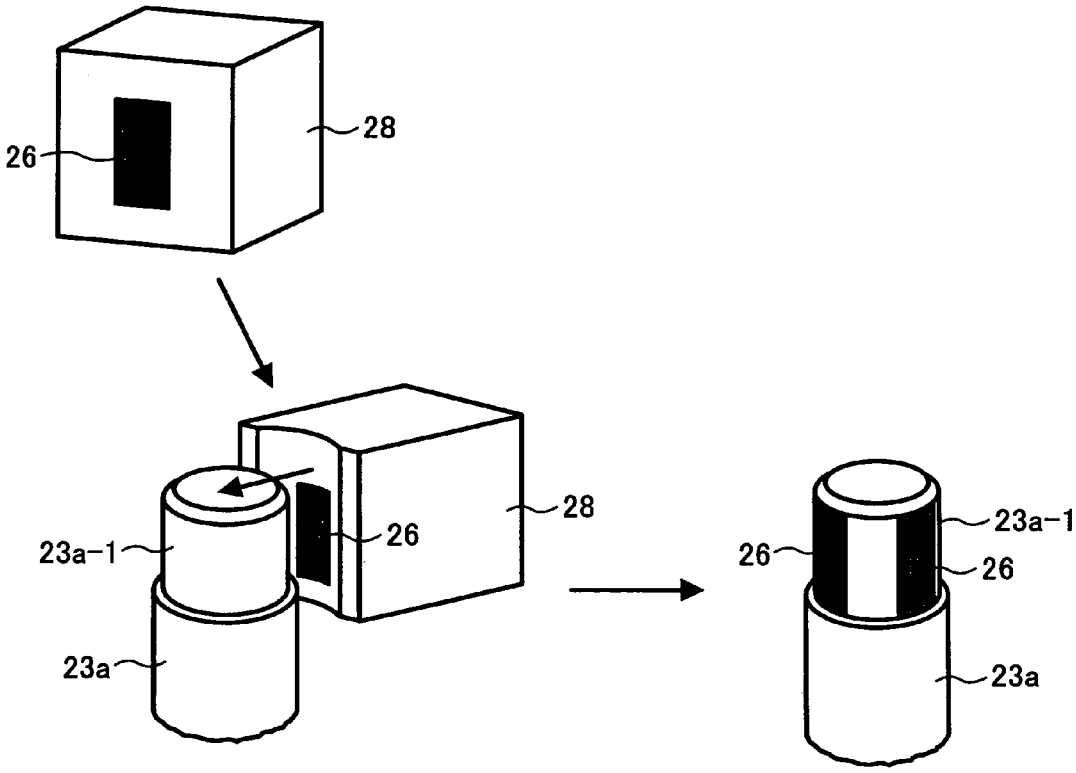
FIG. 9 is a diagram for explaining a method of forming the marker.

FIG. 9 is a diagram for explaining a method of forming the marker 26. The marker 26 is formed on a surface of an elastic member 28 such as a silicon rubber, etc. with silk screen printing, etc., and in the state that the position of the rotation axis 23*a* of the entry roller 23 is fixed, the marker 26 is transferred onto the circumferential surface of the tip end part 23*a*-1 of the rotation axis 23*a* by pressing the elastic member 28 against the circumferential surface of the tip end part 23*a*-1. In this method, the shape of the tip end part 23*a*-1 is not changed as compared with the method of forming an axial end part in the shape of "D", so that an arbitrary number of the markers 26 can be formed on the circumferential surface of the tip end part 23*a*-1. Therefore, by changing the number of the markers 26 to be formed, the detection accuracy can be changed.

Figure 10:
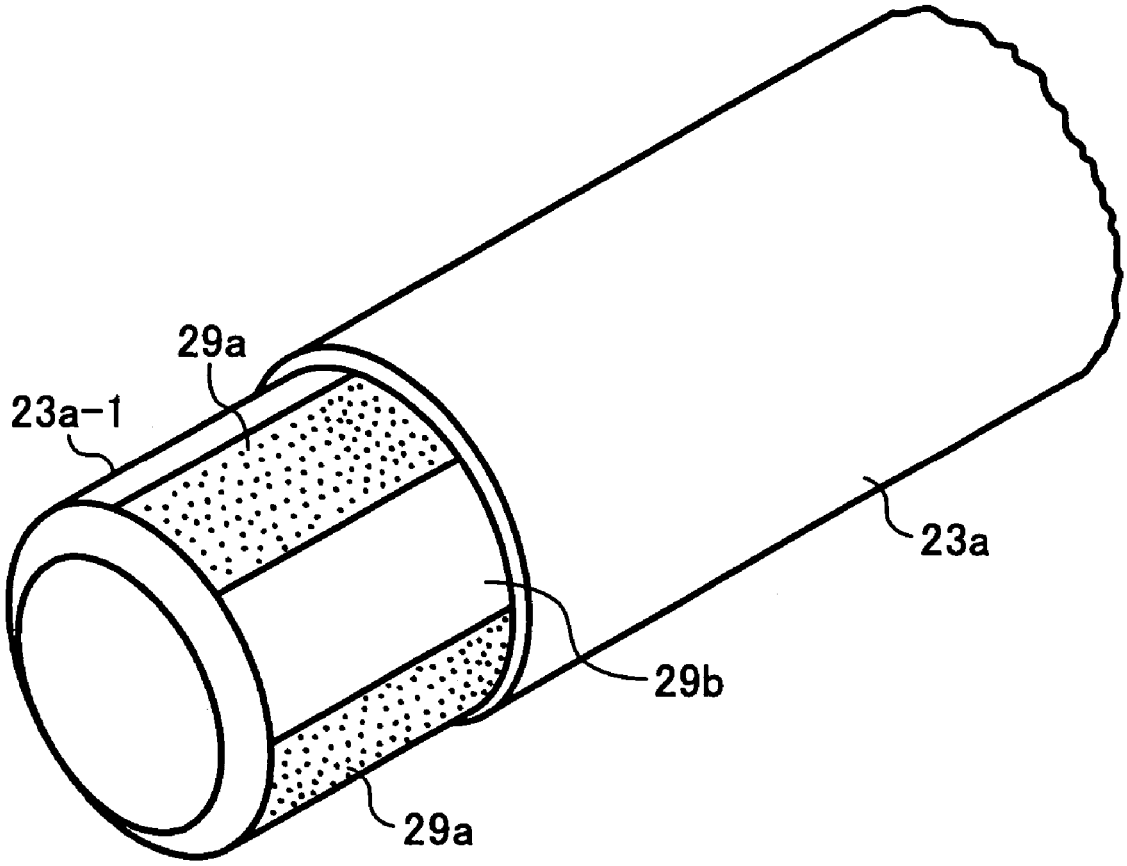
FIG. 10 is a diagram for explaining another method of forming the marker.

FIG. 10 is a diagram for explaining another method of forming the marker 26. In this method, a marker 29*a* is formed on the circumferential surface of the tip end part 23*a*-1 of the rotation axis 23*a* by changing the surface roughness of the region of the circumferential surface of the tip end part 23*a*-1 where the marker 29*a* is to be formed. In this case, the rotation axis 23*a* is made of a metal, and the marker 29*a* is formed by surface processing the region of the marker 29*a* on the circumferential surface of the tip end part 23*a*-1 to have surface roughness larger than that of the other part 29*b*. That is, the marker 29*a* and the other part 29*b* are different in the index indicating the surface roughness, and are different from each other in the surface roughness in the circumferential direction of the tip end part 23*a*-1.

The region of the marker 29*a* on the circumferential surface of the tip end part 23*a*-1 may be processed by such surface processing methods as making the circumferential surface concave and convex with shot peening, etching, affixing a tape processed to have rough surface, etc.

The difference in glossiness between the region of the marker 29 and that of the other part 29*b* is increased by the difference in the surface roughness, and thereby the detection accuracy by the refection-type sensor 27 can be increased.

In the above-described embodiment, the marker 26 or 29*a* is formed on the rotation axis 23*a* of the entry roller 23, and the reflection-type sensor 27 detects the marker 26 or 29*a*. However, the marker 26 or 29*a* may be formed on a rotation axis of the drive roller 21 or the driven roller 22, and the reflection-type sensor 27 may be arranged to detect the marker 26 or 29*a*.

The present invention may be applied to a tandem-type direct transfer system in which toner images on the photoconductors 40 are sequentially transferred onto the transfer sheet 2 born on and conveyed by an endless belt.

Further, the present invention may be applied to a system in which electrostatic latent images are formed on an endless belt as a photoconductor, the latent images are visualized by a plurality of development devices arranged along the endless belt, and the visualized images are transferred onto a recording medium.

Furthermore, the present invention may be applied to a fixing device using an endless belt, in which the endless belt is pressed to contact a recording medium.

Numerous additional modifications and variations of the present invention are possible in light of the above-teachings. It is therefore to be understood that within the scope of the claims, the present invention can be practiced otherwise than as specifically described herein.

What is claimed is:

1. An endless belt device comprising:

an endless belt;

a plurality of rotary members rotatably supporting the endless belt, one of the plurality of rotary members including a marker formed on a part of a circumferential surface of a rotation axis thereof;

a reflection-type sensor arranged to oppose the circumferential surface of the rotation axis of the one of the plurality of rotary members to detect the marker formed on the circumferential surface by detecting reflected light from the marker;

a sensor holder completely surrounding the rotation axis of the one of the plurality of rotary members and supporting the reflection-type sensor, the sensor holder including a bearing part accommodating the rotation axis of the one of the plurality of rotary members; and a frame supporting the plurality of rotary members and the sensor holder, to position the bearing part of the sensor holder to accommodate the rotation axis of the one of the plurality of rotary members, wherein a rotation speed of the endless belt is detected by detecting the marker on the circumferential surface of the rotation axis of the one of the plurality of rotary members by the reflection-type sensor.

2. The endless belt device according to claim 1, wherein the reflection-type sensor and the circumferential surface of the rotation axis of the one of the plurality rotary members are positioned by the sensor holder.

3. The endless belt device according to claim 2, wherein the bearing part of the sensor holder and the rotation axis of the one of the plurality of rotary members slide in contact with each other.

4. The endless belt device according to claim 2, wherein the sensor holder is configured such that the reflection-type sensor and the part of the circumferential surface of the rotation axis of the one of the plurality of rotary members on which the marker is formed are enclosed in an airtight state.

5. The endless belt device according to claim 1, wherein the sensor holder is configured such that at least a periphery of a detection region by the reflection-type sensor does not have a light transmittance function.

6. The endless belt device according to claim 1, wherein the marker is formed by differentiating surface roughness of the part of the circumferential surface of the rotation axis of the one of a plurality of rotary members where the marker is formed from that of the other part of the circumferential surface.

7. The endless belt device according to claim 6, wherein the circumferential surface of the rotation axis of the one of a plurality of rotary members is made of a metal, and the marker is formed by differentiating surface roughness of the part of the circumferential surface of the rotation axis where the marker is formed from that of the other part of the circumferential surface by surface treatment.

8. The endless belt device according to claim 1, wherein the endless belt bears an image.

9. The endless belt device according to claim 1, wherein the endless belt bears a recording medium for forming an image thereupon.

10. The endless belt device according to claim 1, wherein the endless belt contacts and presses a recording medium on which an image has been formed.

11. An image forming apparatus comprising:

a photoconductor; and an endless belt device including an endless belt, wherein an image formed on the photoconductor is transferred onto the endless belt of the endless belt device, and wherein the endless belt device includes:

a plurality of rotary members rotatably supporting the endless belt, one of the plurality of rotary members including a marker formed on a part of a circumferential surface of a rotation axis thereof, a reflection-type sensor arranged to oppose the circumferential surface of the rotation axis of the one of the plurality of rotary members to detect the marker formed on the circumferential surface by detecting reflected light from the marker, a sensor holder completely surrounding the rotation axis of the one of the plurality of rotary members and supporting the reflection-type sensor, the sensor holder including a bearing part accommodating the rotation axis of the one of the plurality of rotary members, a frame supporting the plurality of rotary members and the sensor holder, to position the bearing part of the sensor holder to accommodate the rotation axis of the one of the plurality of rotary members, and a rotation speed of the endless belt is detected by detecting the marker on the circumferential surface of the rotation axis of the one of the plurality of rotary members by the reflection-type sensor.

12. An image forming apparatus comprising:

a photoconductor; and an endless belt device including an endless belt, wherein an image formed on the photoconductor is transferred onto a recording medium born on the endless belt of the endless belt device, and wherein the endless belt device includes:

a plurality of rotary members rotatably supporting the endless belt, one of the plurality of rotary members including:

a marker formed on a part of a circumferential surface of a rotation axis thereof, a reflection-type sensor arranged to oppose the circumferential surface of the rotation axis of the one of the plurality of rotary members to detect the marker formed on the circumferential surface by detecting reflected light from the marker, a sensor holder completely surrounding the rotation axis of the one of the plurality of rotary members and supporting the reflection-type sensor, the sensor holder including a bearing part accommodating the rotation axis of the one of the plurality of rotary members, a frame supporting the plurality of rotary members and the sensor holder, to position the bearing part of the sensor holder to accommodate the rotation axis of the one of the plurality of rotary members, and a rotation speed of the endless belt is detected by detecting the marker on the circumferential surface of the rotation axis of the one of the plurality of rotary members by the reflection-type sensor.

13. An image forming apparatus comprising:

a photoconductor; and an endless belt device including an endless belt, wherein the endless belt of the endless belt device is brought into contact with a recording medium on which an image formed on the photoconductor has been transferred, and wherein the endless belt device includes:

a plurality of rotary members rotatably supporting the endless belt, one of the plurality of rotary members including:

a marker formed on a part of a circumferential surface of a rotation axis thereof, a reflection-type sensor arranged to oppose the circumferential surface of the rotation axis of the one of the plurality of rotary members to detect the marker formed on the circumferential surface by detecting reflected light from the marker, a sensor holder completely surrounding the rotation axis of the one of the plurality of rotary members and supporting the reflection-type sensor, the sensor holder including a bearing part accommodating the rotation axis of the one of the plurality of rotary members, a frame supporting the plurality of rotary members and the sensor holder, to position the bearing part of the sensor holder to accommodate the rotation axis of the one of the plurality of rotary members, and a rotation speed of the endless belt is detected by detecting the marker on the circumferential surface of the rotation axis of the one of the plurality of rotary members by the reflection-type sensor.

* * * * *